United States Patent [19]

Nishi

[11] 4,165,699

[45] Aug. 28, 1979

[54] PRESSER FOOT FOR SEWING MACHINE

[76] Inventor: Naoichi Nishi, No. 1012, Aza Hiyoshicho, Oaza Sanjo, Sanjo City, Niigata Prefecture, Japan

[21] Appl. No.: 867,179

[22] Filed: Jan. 5, 1978

[30] Foreign Application Priority Data

Aug. 26, 1977 [JP] Japan ..... 52-113388[U]
Nov. 5, 1977 [JP] Japan ..... 52-148805[U]

[51] Int. Cl.[2] ..... D05B 29/12; D05B 87/04
[52] U.S. Cl. ..... 112/240; 112/224
[58] Field of Search ..... 112/224, 235, 240

[56] References Cited

U.S. PATENT DOCUMENTS

| | | | |
|---|---|---|---|
| 907,485 | 12/1908 | Fellows | 112/260 |
| 1,721,628 | 7/1929 | Ingham | 26/70 X |
| 3,143,094 | 8/1964 | Yamada | 112/235 |
| 3,800,720 | 4/1974 | Niino | 112/235 |

*Primary Examiner*—Wm. Carter Reynolds
*Attorney, Agent, or Firm*—Wenderoth, Lind & Ponack

[57] ABSTRACT

A presser foot for a sewing machine includes a shank detachably connected to a sewing machine presser foot bar. The shank has a transverse slot formed at the bottom thereof and a lug provided with a slit extending rearwardly from the back thereof. A lever is pivotally connected to the lug. A plate bridges both the lug and the lever to hold opposite ends of a torsion spring positioned in the slit of the lug to urge the lever by its biasing force. A rod is connected at its base to the lower end of the lever and movably extends through a longitudinal bore to project into the transverse slot of the shank until a stopper of the rod touches the edge of the bore. A presser foot shoe has a pair of supports for supporting a shaft extending transversely of the shoe and adapted to be received in the transverse slot and retained therein by the forward end of the rod closing the open side of the transverse slot. The shank is formed with a vertical groove at one side thereof for receiving the presser foot bar therein and has a colored plate arranged on the front thereof to prevent reflection of rays thereon.

4 Claims, 9 Drawing Figures

PRESSER FOOT FOR SEWING MACHINE

BACKGROUND AND BRIEF SUMMARY OF THE INVENTION

This invention relates to a presser foot. More specifically the present invention contemplates providing a presser foot which permits a shoe to be attached to or detached from a shank with smoothness and accuracy, and which enables the operator to easily perform a threading operation, regardless of shining on the front surface of the shank due to reflected rays.

In one type of well-known presser foot for sewing machines, a shank and a presser shoe are formed separately in two pieces.

The pressor foot comprises a shank detachably connected to the sewing machine presser foot bar, the shank being formed with a vertical groove at one side thereof for receiving the presser foot bar therein and having a transverse slot formed at the bottom to extend from side to side of the shank and a plurality of lugs extending forwardly from the back of the shank, the shank being further formed with a longitudinal bore extending forwardly from the back of the shank and opening into the transverse slot. A lever is pivotally connected to the pair of lugs, a wire is connected to the lower end of the lever and movably extends through the longitudinal bore so that its forward end projects into a transverse slot. Means including a torsion spring normally urge the wire to close at its forward end the open side of the transverse slot. A presser foot shoe has a pair of supports extending along opposite sides of the upper surface of the shoe, and a shaft mounted on the supports extends transversely of the shoe and is adapted to be received in the transverse slot formed in the shank and retained therein by the forward end portion of the wire closing the open side of the transverse slot.

In this type of presser foot described heretofore there is provided a wire connected at its base to the lower end of the lever and movably extending through the longitudinal bore by means of the lever.

The wire sometimes fails to function properly when it moves through the longitudinal bore. Its forward end may project to deeply into the transverse slot to be drawn backward, or the end may contact too tightly underneath the shaft of the shoe retained in the slot, whereby the shank becomes undetachable from the shoe. Also, the forward end of the wire may not move far enough into the slot to support the shaft, whereby the shank is not properly connected to the shoe.

The object of the present invention is to overcome the aforementioned drawbacks by providing a rod with a stopper devised to adjust distance of movement of the rod through the longitudinal bore.

The forward and backward movement of the rod through the longitudinal bore is performed by the lever urged by the biasing force of a torsion spring fitted in lugs of the presser foot. However, the torsion spring may easily be deformed by frequent uses. Accordingly, another object of this invention is to provide means to eliminate the aforementioned drawback.

Another type of well-known presser foot comprises a shank detachably connected to a sewing machine presser foot bar and a presser foot shoe undetachably connected to the shank, as compared with the first type of presser foot wherein a shank and a shoe are formed seperately in two pieces.

When threading a needle of a sewing machine equipped with either type of presser foot heretofore explained, an operator usually sits in front of the sewing machine head, facing the needle and tries to thread the needle from the front side to the rear side through the needle hole by hand.

Since the sewing machine parts, such as the needle, the needle-bar, the presser foot, are usually plated with chromium or nickel, the operator finds it difficult to locate the needle hole for threading due to reflected rays on the surface of the plated parts.

A further object of this invention is to provide a presser foot with a shank whose vertical front portion is so arranged that the reflection of light rays thereon is prevented so that the operator is able to locate the needle hole with ease, whereby threading is performed efficiently.

Other and further objects of this invention will become obvious upon an understanding of the illustrative embodiments about to be described or will be indicated in the appended claims, and various advantages not referred to herein will occur to one skilled in the art upon employment of the invention in practice.

DETAILED DESCRIPTION OF THE INVENTION

Figure 1:
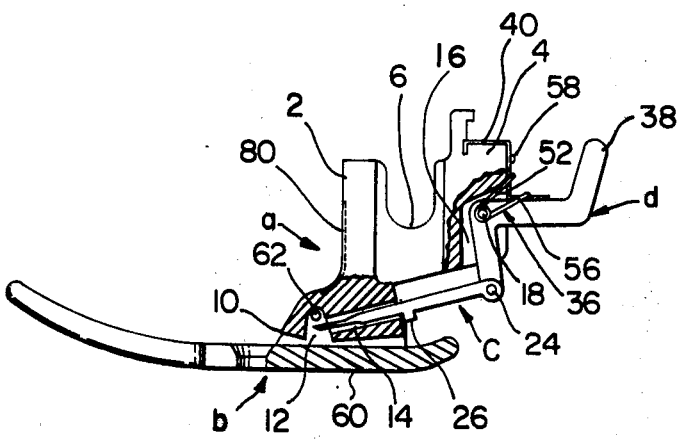
FIG. 1 is a side view of the presser foot for sewing machines embodying the invention, partially broken away and in section.
Figure 2:
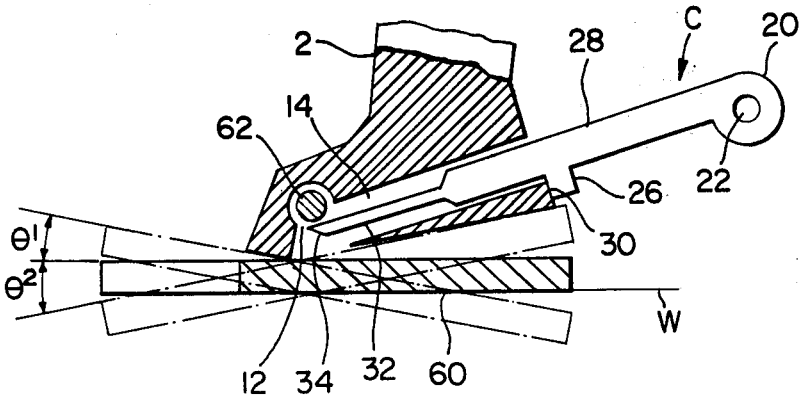
FIG. 2 is an enlarged side view of the main part of the presser foot shown in FIG. 1.

Referring first to the embodiment of the invention shown in FIG. 1-9 inclusive, the presser foot comprises a presser foot shank (a), a presser foot shoe (b), a rod (c) which detachably connects the shank and the shoe, and a lever (d) functioning to move the rod (c) forward and backward through a longitudinal bore 14 arranged in the shank (a), as hereinafter described.

The shank (a) comprises a vertical portion 2, a lug portion 4, the former having a groove 6 for receiving the presser foot bar 8 therein, and a horizontal portion 10 being formed with a slot 12 extending from side to side, and with longitudinal bore 14 extending forwardly from the back of the horizontal portion 10 to open into the slot 12.

A slit 16 arranged at the back of the lug 4 receives the lever (d) therein, and the lever is pivotally connected to a shaft 18 bridging the slit 16, as hereinafter described.

Figure 4:
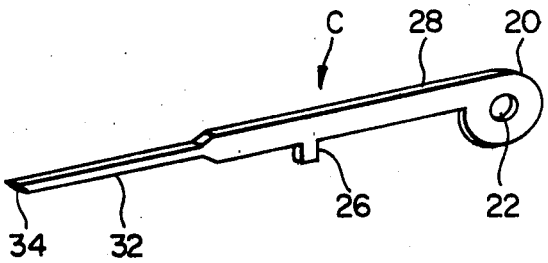
FIG. 4 is an enlarged perspective view of the rod of this invention.

Rod (c) as is illustrated in FIG. 4, is usually formed in the shape of a flat plate including a head 20 having an opening 22 for receiving a rivet 24 arranged at the lower portion of the lever (d), a body portion 28 having a stopper 26 arranged on the underside thereof and which contacts an edge 30 of the longitudinal bore 14 when the rod (c) moves forward into bore 14 by biasing force of the lever (d), as hereinafter described, and a leg 32 having a tapered edge 34. The width of leg 32 is narrower than that of the body 28. Plural stoppers may be disposed to protrude in opposite directions from both sides of the rod.

The upper portion of lever (d) is pivotally connected to the shaft 18 bridging the slit 16 disposed in the lug 4, while the lower portion of the lever (d) is also pivotally connected to the rod (c) by means of the rivet 24, whereby the lever (d) is urged by the biasing force of a torsion spring 36 arranged in the lug 4.

As heretofore described, when the lever (d) is urged by the biasing force of the torsion spring 36 to move clockwise (as reviewed in FIG. 1) and the rod (c) extends through the bore 14, the rod (c) is movable into bore 14 until the stopper 26 touches the edge 30 of the bore 14. At this position the front end portion of rod (c) close the lower open side of the slot 12 and retains the shaft 62 of the shoe (b) at the position in the slot 12, and accordingly the shank (a) and the presser foot shoe (b) are efficiently connected. By pushing and moving the lever (d) in a counterclockwise direction against the biasing force of the torsion spring 36, the rod (c) will be moved rearwardly by a predetermined distance, until the forward portion of rod (c) is withdrawn to open the slot 12, and thus the shank (a) and the presser foot shoe (b) may be disconnected with accuracy and ease.

Figure 6:
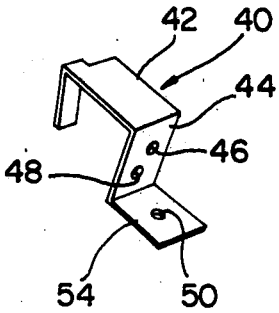
FIG. 6 is an enlarged perspective view of the supporting plate.

An elastic flexible supporting plate 40 which is preferably of metal or plastics, as shown in FIGS. 1 and 6, comprises an upper flat portion 42, a vertical portion 44 having a screw hole 46 and a hole 48 for relatively slidably supporting one of the ends or arms 52 of torsion spring 36 and a lower flat portion 54 having a hole 50 for relatively slidably supporting the other end or arm 56 of the torsion spring 36. When the plate 40 is arranged to be connected to the lug 4 by means of a screw 58 through screw hole 46, the lug 4 and the lever (d) are bridged by plate 40. Thereby the plate 40 holds the torsion spring 36, with arms 52, 56 of spring 36 protruding through holes 48, 50 respectively, so that the torsion spring 36 is firmly supported by the plate 40 and is positioned so that it will not undergo deformation caused by frequent use.

Thus, the elastic plate 40 is connected to the lug 4 by means of a screw 58 arranged through the screw hole 46, with the arms 52, 56 of the torsion spring 36 protruding through holes 48, 50 of the supporting plate 40, respectively.

Figure 3:
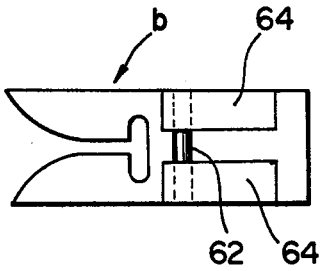
FIG. 3 is a plan view of the shoe shown in FIG. 1.

As shown in FIG. 3, presser foot shoe (b) has a horizontal portion 60 and is provided with a pair of supports 64 extending along opposite sides of its upper surface. Supports 64 are bridged by shaft 62. The forward and rearward sections of the bottom of the shank are inclined, and a clearance is provided between the upper surface of the shoe and the lower surface of the shank (a), whereby the shoe (b) may pivot through angles $\theta^1$ and $\theta^2$ to move smoothly over the cloth (w) placed beneath the shoe.

Figure 9:
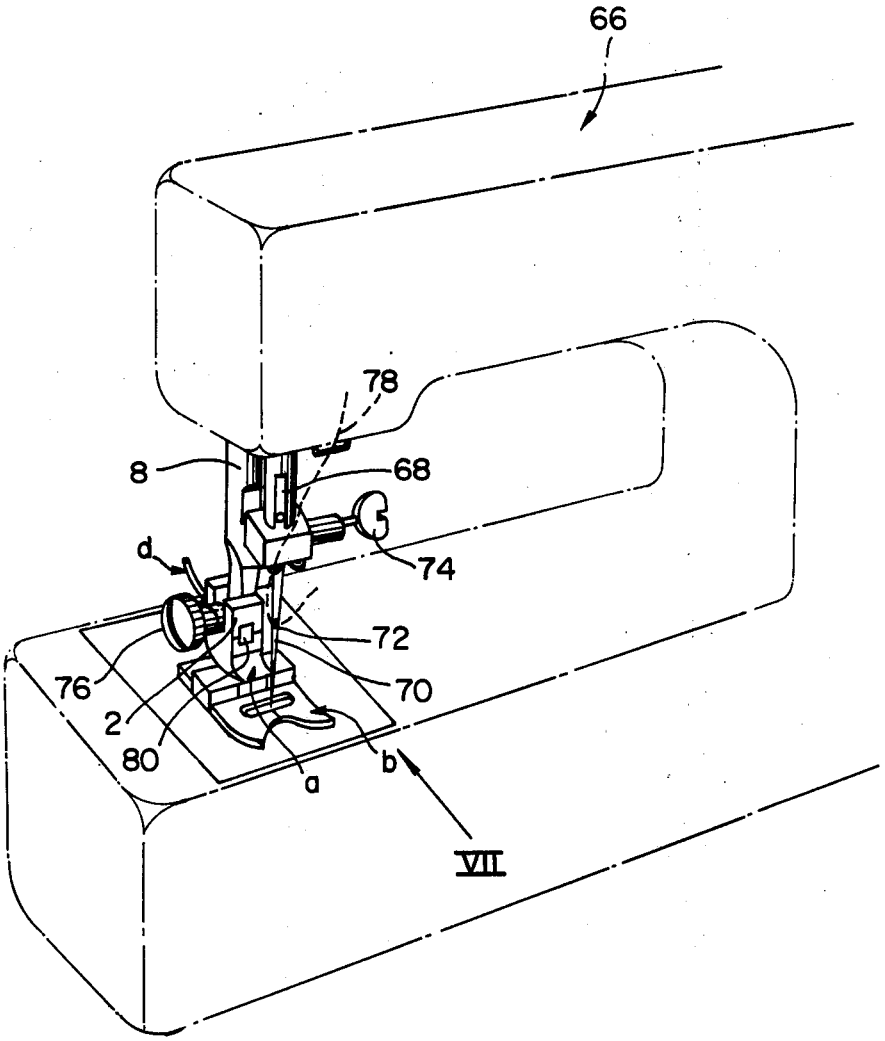
FIG. 9 is a perspective view of the sewing machine head provided with a presser foot bar fitted with the presser foot of this invention and a needle bar having a needle for threading.

FIG. 9 illustrates a conventional sewing machine head 66 equipped with a presser foot bar 8, a presser foot including a shank, a rod, a lever and a shoe, and a needle bar 68 connected to a needle 70 having a needle hole 72 by means of a thumb screw 74. The presser foot is also removably attached to the presser foot bar 8 by means of thumb screw 76.

An operator usually sits in front of the sewing machine head 66, facing to the needle 70 and tries to thread the needle from the front side to the rear side through the needle hole 72 by using a piece of thread 78, when the needle bar 68 is in the raised position. However, due to reflected rays on the surface of the chromium or nickel plated presser foot it is difficult for the operator to locate the needle hole 72 through which threading is to be performed by hand.

Figure 7:
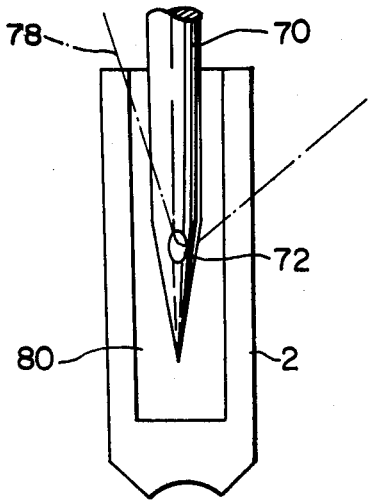
FIG. 7 is an enlarged front view of the needle and the vertical front of the shank partially illustrated, as seen from the direction of arrow VII shown in FIG. 9.

For the purpose of overcoming the difficulty of locating the needle hole 72 for threading, a colored plate 80, preferably of a white color, is attached on the surface of vertical front portion 2 of the shank (a), as shown in FIG. 7. Thereby the operator is able to see from the front to the rear through the needle hole 72 without his eyes being influenced or disturbed by reflected rays on the surface of the vertical front 2 of the shank (a) and other attachments, and threading of the needle is performed with ease.

Figure 8:
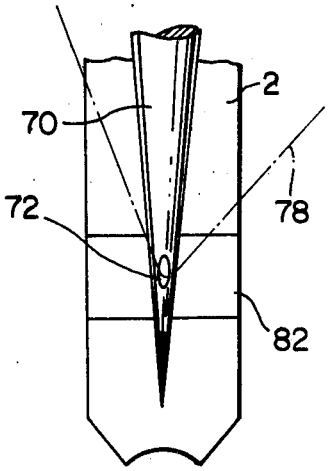
FIG. 8 illustrates a modified embodiment of the colored plate shown in FIG. 7.
Figure 5:
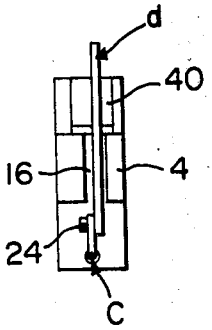
FIG. 5 is a rear view of the shank.

FIG. 8 illustrates another embodiment of a colored band 82 attached around the shank front 2.

What is claimed is:

1. A presser foot for use in a sewing machine, said presser foot comprising:

a shank including an upper vertical portion, a lower horizontal portion, and a lug extending in a rearward direction from said upper portion, said upper vertical portion having therein a groove for receiving a presser foot bar of a sewing machine, said lower horizontal portion having formed therein a transverse slot opening onto a bottom surface of said lower horizontal portion, said lug having formed therein an upwardly extending slit, and said lower horizontal portion having therein a longitudinal bore extending rearwardly from a first end opening into said transverse slot to a second end opening onto a rear surface of said lower horizontal portion;

a presser foot shoe having thereon a pair of supports, and a shaft extending transversely of said shoe between said supports, said shaft being dimensioned to be received within said transverse slot;

a rod having a first inner end and a second outer end, said rod being mounted within said bore for sliding movement therein between a first position whereat said inner end of said rod extends into said transverse slot to retain therein said shaft and a second position whereat said inner end of said rod is retracted from said transverse slot into said bore and said shaft may be removed from or inserted into said transverse slot, said rod having extending therefrom stopper means for abutting against said rear surface of said lower horizontal portion and for thereby limiting the movement of said rod toward said first position thereof;

a lever pivotally mounted within said slit in said lug, said lever having a lower end pivotally connected to said outer end of said rod, said lever being pivotable in a first direction moving said rod toward said first position thereof, and said lever being pivotable in a second direction moving said rod toward said second position thereof;

an elastic flexible plate connected to said lug and bearing on said lever, said plate having therein first and second openings; and torsion spring means, having first and second arms slidably extending through said first and second openings of said plate, respectively, for urging said plate against said lever and for thereby urging said lever to pivot in said first direction.

2. A presser foot as claimed in claim 1, wherein said rod comprises a flat plate including a body portion and a leg portion of smaller width than that of said body portion, said body portion having extending therefrom said stopper means, and said leg portion comprising said inner end.

3. A presser foot as claimed in claim 1, wherein said upper vertical portion of said shank has a front surface having thereon colored plate means for preventing the reflection of light rays therefrom.

4. A presser foot as claimed in claim 1, wherein said upper vertical portion of said shank has provided therearound colored band means for preventing the reflection of light rays therefrom.

* * * * *